US011223113B2

(12) United States Patent
Hicks et al.

(10) Patent No.: US 11,223,113 B2
(45) Date of Patent: Jan. 11, 2022

(54) ROOF MOUNTED ANTENNA FOR RECREATIONAL VEHICLES AND THE LIKE

(71) Applicant: Steiner Enterprises, Lafayette, IN (US)

(72) Inventors: Thomas P. Hicks, Lafayette, IN (US); Donald E. DeWitt, Syracuse, IN (US); Joshua E. DeWitt, Westfield, IN (US)

(73) Assignee: Steiner Enterprises, Lafayette, IN (US)

( * ) Notice: Subject to any disclaimer, the term of this patent is extended or adjusted under 35 U.S.C. 154(b) by 0 days.

(21) Appl. No.: 16/912,824

(22) Filed: Jun. 26, 2020

(65) Prior Publication Data

US 2020/0411972 A1 Dec. 31, 2020

Related U.S. Application Data

(60) Provisional application No. 62/867,934, filed on Jun. 28, 2019.

(51) Int. Cl.
*H01Q 1/32* (2006.01)
*H01Q 9/04* (2006.01)
*H01Q 1/12* (2006.01)

(52) U.S. Cl.
CPC ..... *H01Q 1/3275* (2013.01); *H01Q 1/12* (2013.01); *H01Q 9/0407* (2013.01)

(58) Field of Classification Search
CPC ..... H01Q 1/3275; H01Q 5/30; H01Q 9/0407; H01Q 1/32
See application file for complete search history.

(56) References Cited

U.S. PATENT DOCUMENTS

2005/0093755 A1* 5/2005 Byrne ..... H01Q 1/3275 343/713
2013/0249748 A1* 9/2013 Togura ..... H01Q 1/36 343/713
2016/0064807 A1* 3/2016 Reed ..... H01Q 1/38 343/713
2018/0083348 A1* 3/2018 Thiam ..... H01Q 9/0407
2018/0301796 A1* 10/2018 Yamase ..... H01Q 1/36

* cited by examiner

*Primary Examiner* — Hasan Islam

(74) *Attorney, Agent, or Firm* — Maginot, Moore & Beck, LLP

(57) ABSTRACT

An antenna assembly for mounting on the roof of a recreational vehicle includes a planar antenna structure configured to receive UHF/VHF signals and a shark fin shaped body sized to surround the planar antenna structure vertically oriented relative to the vehicle. The body includes a mounting flange adapted to be fastened to the roof of the vehicle, and a cover attached to the body to completely enclose the planar antenna structure. The cover includes a flange extending from a bottom surface of the cover for engagement within a complementary opening in the roof of the vehicle. The antenna structure includes a printed circuit board with electrical terminals extending therefrom into the flange for connection to TV cables of the vehicle.

16 Claims, 7 Drawing Sheets

ROOF MOUNTED ANTENNA FOR RECREATIONAL VEHICLES AND THE LIKE

PRIORITY CLAIM

This application is a utility filing of and claims priority to U.S. provisional application No. 62/867,934, filed on Jun. 28, 2019, the entire disclosure of which is incorporated herein by reference.

BACKGROUND

Many recreational vehicle owners and users enhance their traveling experience with television and radio. Consequently, the RV roof-mounted antenna market has grown considerably over the years. However, one detriment to the roof-mounted antenna is that it is at risk of damage or even removal by contact with low hanging foliage. Roof mounting is necessary to provide adequate signal reception for the television or radio within the RV. There is a need for an antenna that is easily mounted on the roof of an RV and that can withstand the forces from the occasional contact with trees and other foliage.

SUMMARY OF THE DISCLOSURE

An antenna assembly for mounting on the roof of a vehicle includes a planar antenna structure configured to receive UHF/VHF signals and a printed circuit board (PCB) electrically connected to the antenna structure for processing signals received by the antenna structure. The PCB has electrical terminals extending therefrom configured for removable connection to a corresponding cable of the vehicle. The antenna assembly further includes a body sized to surround the planar antenna structure with the planar antenna structure vertically oriented relative to the vehicle. The body includes a mounting flange adapted to be fastened to the roof of the vehicle.

A cover is attached to the body to complete enclose the planar antenna structure. The cover includes a flange extending from a bottom surface of the cover for engagement within a complementary opening in the roof of the vehicle, to simplify the installation of the antenna assembly. The flange defines an opening to permit connection of TV cables from the vehicle with electrical terminals.

The body has a shark fin configuration with an angled leading edge and a low lateral profile. The body configuration helps the antenna assembly to resist contact with low-hanging foliage that the vehicle may drive under. The profile helps push the foliage aside without damaging the planar antenna inside.

DETAILED DESCRIPTION

Figure 1:
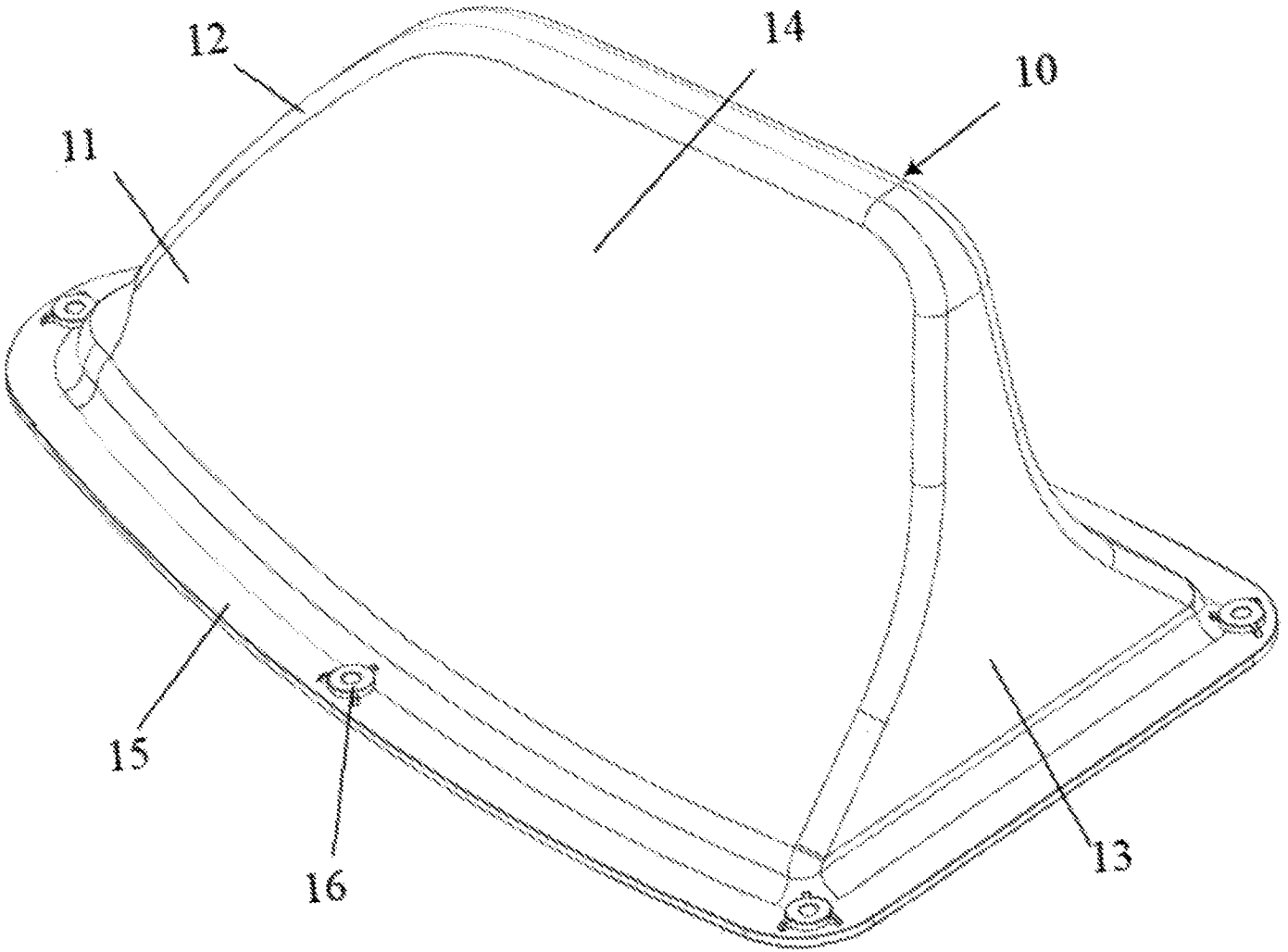
FIG. 1 is a perspective view of an antenna assembly according to one embodiment of the present disclosure.

For the purposes of promoting an understanding of the principles of the disclosure, reference will now be made to the embodiments illustrated in the drawings and described in the following written specification. It is understood that no limitation to the scope of the disclosure is thereby intended. It is further understood that the present disclosure includes any alterations and modifications to the illustrated embodiments and includes further applications of the principles disclosed herein as would normally occur to one skilled in the art to which this disclosure pertains.

An antenna assembly 10 shown in FIG. 1 incorporates a "shark fin" configuration in its body 11. In particular, the body 11 is a hollow shell that houses and protects the working components of the antenna assembly. The body includes a leading edge 12 that is angled rearwardly when mounted on the roof of a vehicle, such as an RV. In particular, the assembly is mounted on the vehicle roof with the leading edge 12 facing the front of the vehicle. The angle of the leading edge 12 helps the antenna assembly 10 shed a tree branch contacting the top of the vehicle. In one embodiment, the leading edge is at an angle of 40-60° relative to the mounting flange 15 that is fastened to the roof. The angle is established by the size of the components inside the body 11, as described herein, by the desire to keep the assembly at as low a profile as possible and by the optimum angle to deflect foliage and other flexible objects. A steeper angle can reduce the overall length of the assembly, but at the cost of being less effective at deflecting foliage. A shallower angle is highly effective at deflecting foliage but undesirably increases the overall length of the antenna assembly.

The side walls of the body 14 expand from the leading edge 12 to a profiled rear face 13. As best shown in FIG. 3*c* the rear face 13 and side walls 14 define a sleek profile that is narrowest at the apex 13*a* of the body and that expands in width gradually to the base of the body that is in direct contact with the roof of the vehicle. The side walls 14 are curved from the apex 13*a* to the base 13*b* of the rear face, similar in shape to a portion of one branch of a hyperbola, with the angle of slope being minimal at the apex and gradually increasing toward the base 13*b*. The exterior shell defined by the body 11 thus forms a sleek and aerodynamic profile that not only minimizes wind resistance but also presents a small cross-section that can be impacted by foliage as the vehicle is driven through low having branches, for instance. Moreover, the body has a narrow width at the apex of the body that might contact the foliage first, thereby reducing the risk of contact in the first place. This contour helps the antenna assembly 10 divert a branch, for instance, that might initially contact the leading edge 12 of the body, again minimizing the load applied to the antenna assembly 10 by the branch or other foliage.

The body includes a mounting flange 15 around the perimeter of the body 11 that is configured to seat flush on the roof of the vehicle. The flange may be generally flat and planar or may exhibit a contour corresponding to a contour in the roof of the vehicle. Alternatively, the mounting flange 15 may have some degree of flexibility to allow the flange to conform to a non-planar roof. The mounting flange 15 includes bolt holes 15*a* configured to receive a plurality of mounting fasteners 16 spaced around the perimeter of the flange, as shown in FIG. 3*b*. The fasteners are configured to securely fasten the body 11, and thus the antenna assembly 10, to the roof or other outer surface of the vehicle. The fasteners may be metal screws, for instance, with a rubber washer for sealing the bolt holes 15*a* in the antenna assembly 10 and the corresponding holes formed in the vehicle roof.

Figure 2:
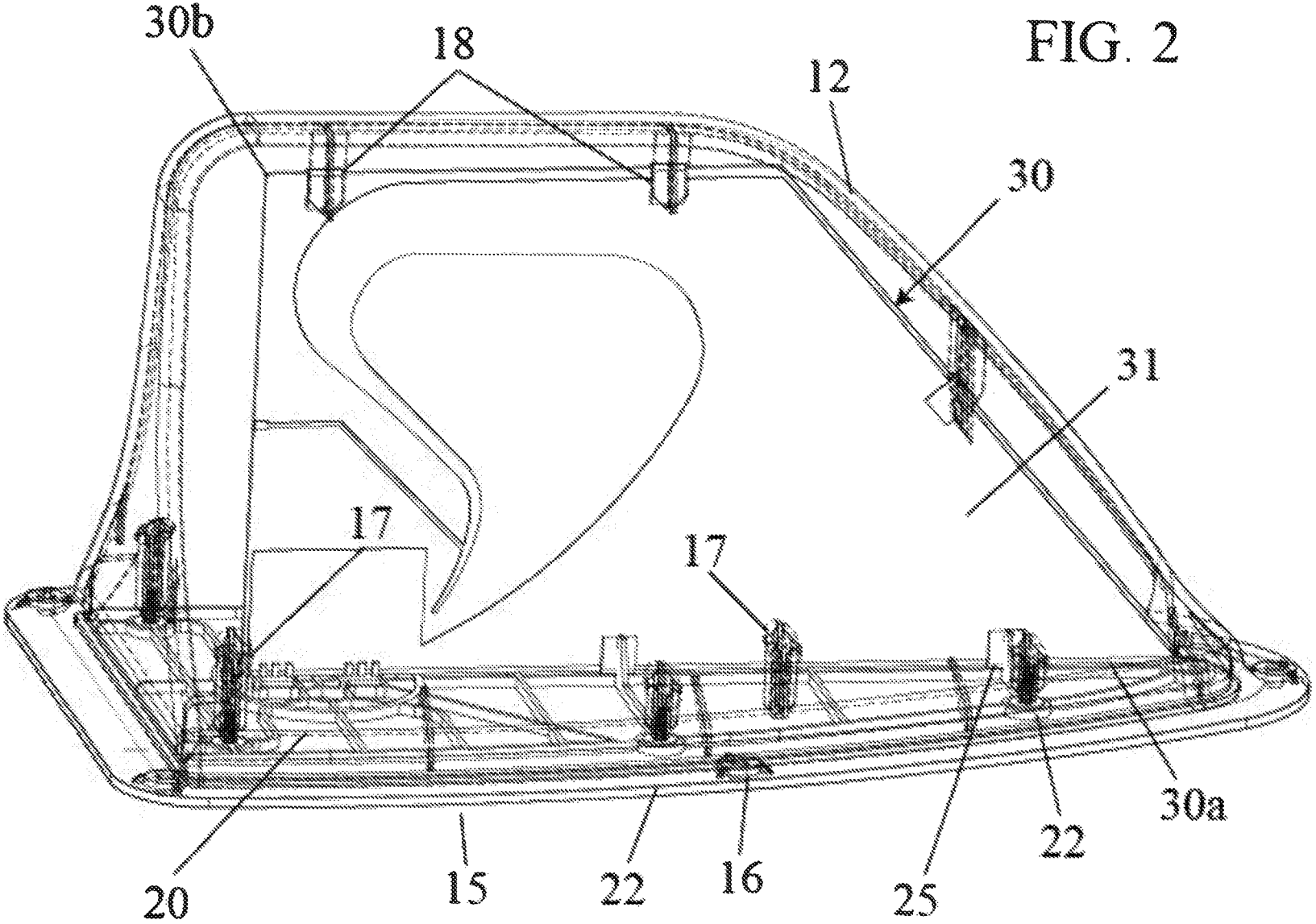
FIG. 2 is a perspective partial cut-away view of the antenna assembly shown in FIG. 1.

The interior of the flange 15 is configured to receive a complementary configured cover 20, as shown in FIG. 3*b*. The cover includes a plurality of fasteners 22 that are adapted to engage mounting bosses 17 defined on the inside of the body 11, as shown in FIG. 2. As shown in FIG. 3*b*, the cover includes a plate 21 that is sized to fit inside the flange 15 of the body 11 so that the plate 21 is flush with the underside of the flange, thereby presenting a uniform surface to be mounted to the roof or other surface of the vehicle. As with the mounting flange 15, the plate 21 can be planar or can be contoured to match the contour of the vehicle roof. The plate may also exhibit some flexibility to conform to the vehicle roof as needed.

Figure 3A:
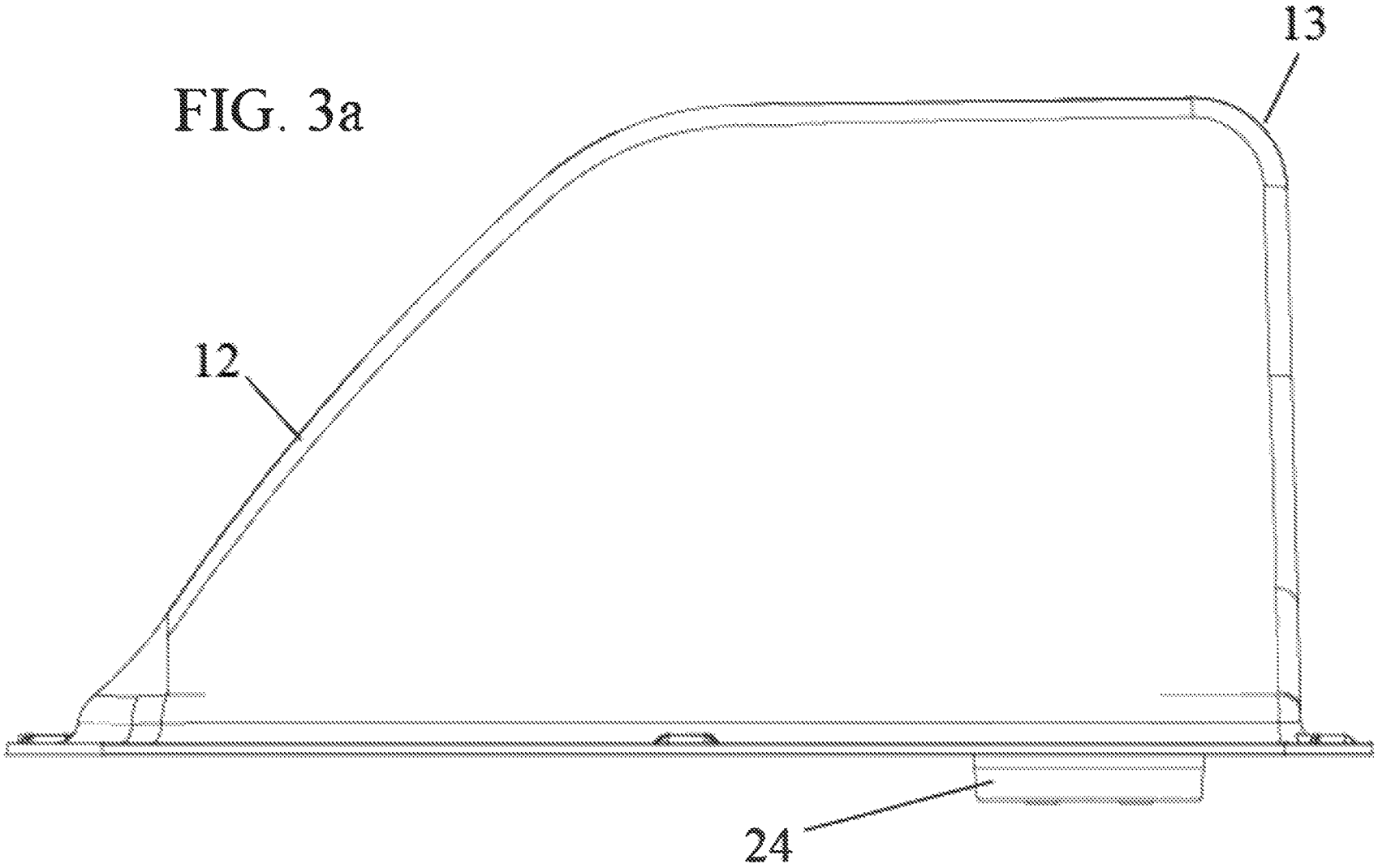
FIGS. 3*a*, 3*b* and 3*c* are side, bottom, and end views of the antenna assembly shown in FIG. 1.
Figure 3B:
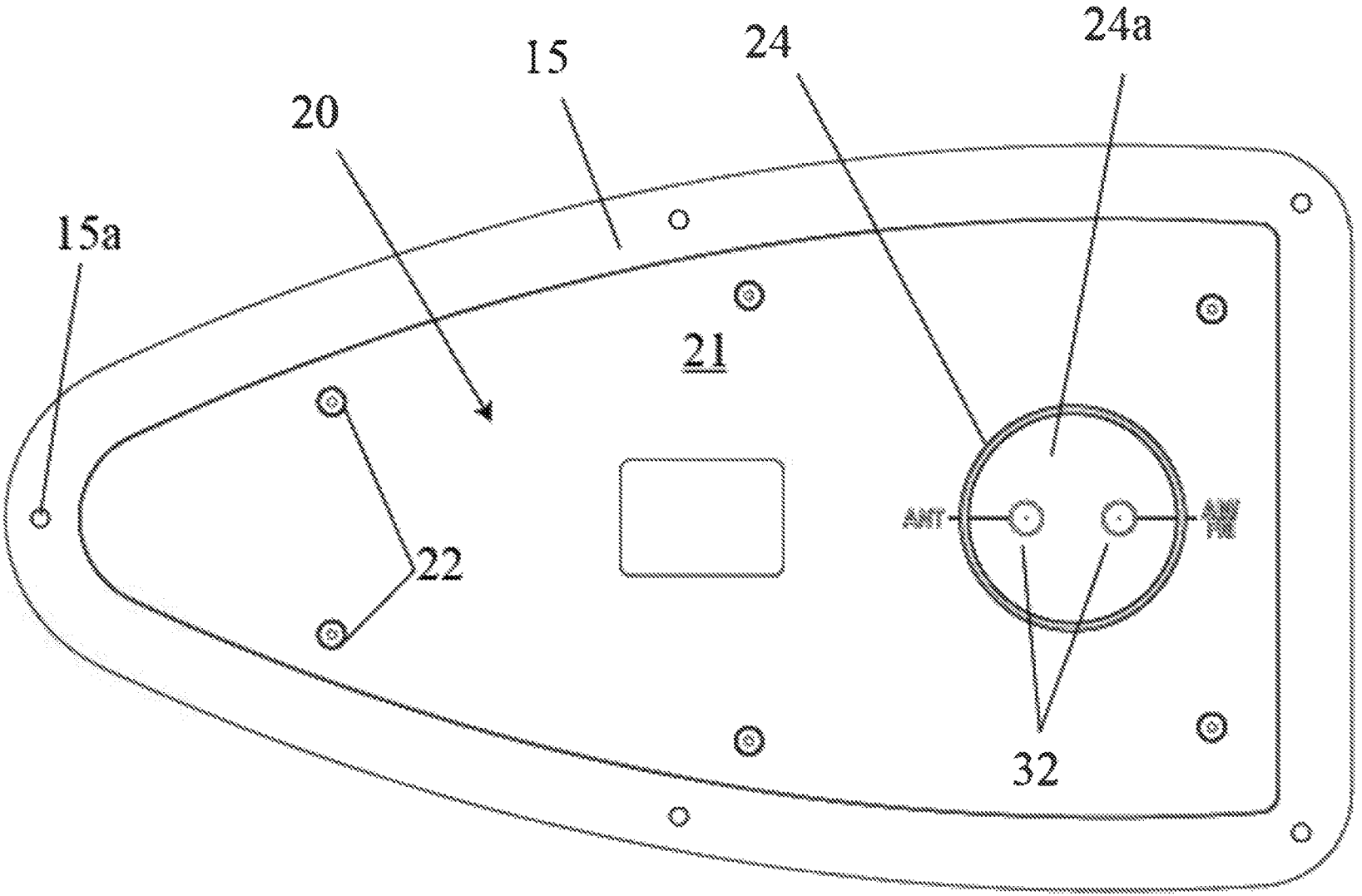
Figure 3C:
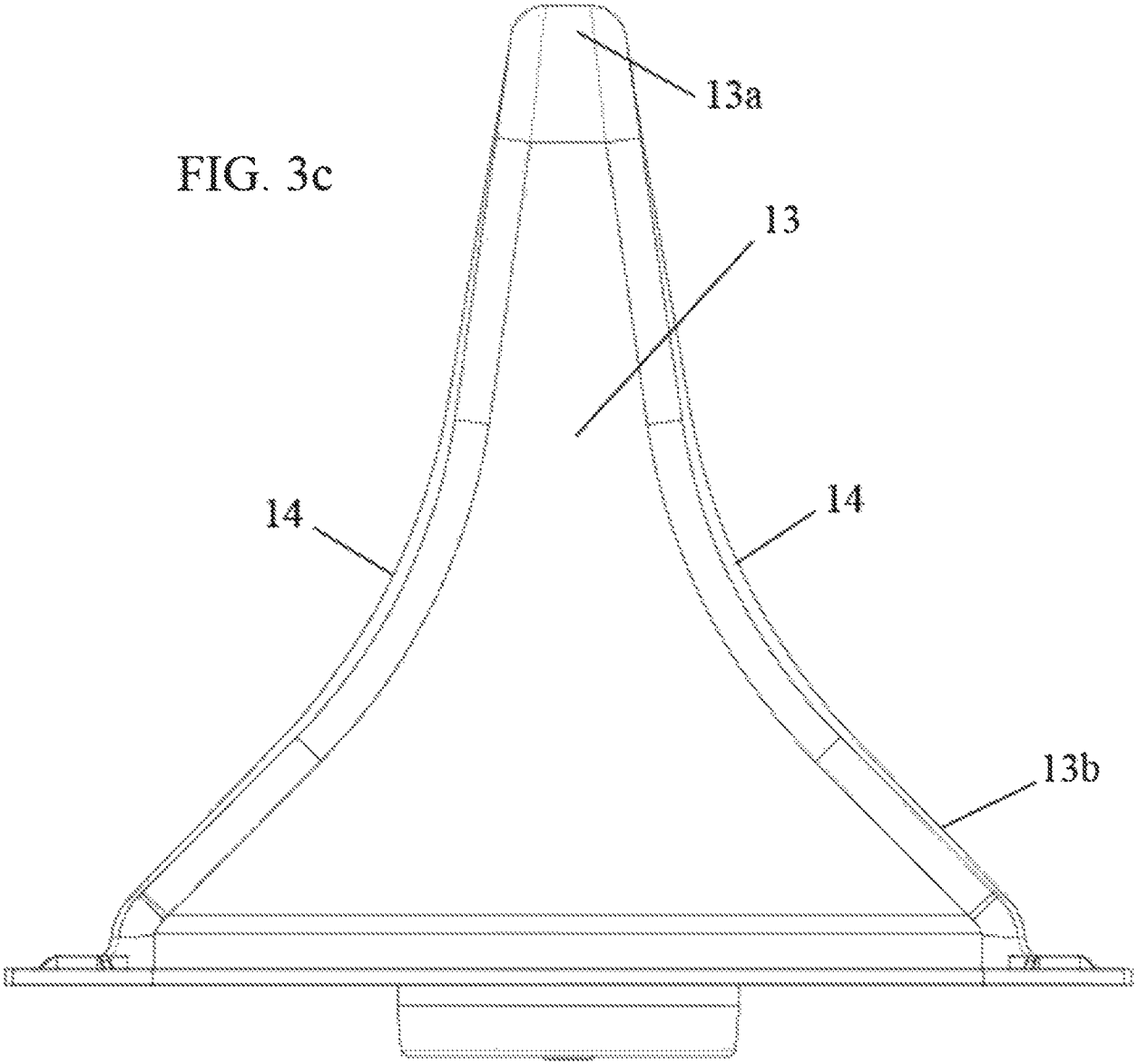

The plate 21 includes a flange 24 that projects downward from the surface of the plate facing the vehicle when the antenna assembly is installed, as best seen in FIG. 3*a*. The flange 24 is preferably circular and is sized to correspond to a conventional access opening drilled in the roof of the vehicle to receive the antenna cabling for connection between the antenna assembly outside the vehicle and the television and/or radio inside the vehicle. The flange 24 thus provides a self-aligning feature between the antenna assembly and the vehicle that greatly simplifies mounting the antenna assembly to the vehicle. It is contemplated that the flange 24 forms a tight, and even press-fit, engagement with the opening formed in the roof, to provide a water-tight seal. Alternatively, or additionally, the flange 24 may be provided with a seal ring between the plate 21 and the flange 24, or embedded within the circumference of the flange. Alternatively or additionally, a gasket may be provided between the antenna assembly 10 and the vehicle roof, with the gasket configured to conform to the outer perimeter of the mounting flange and to cover at least the mounting flange, and preferably the entire cover 20, with holes as needed to receive the flange 24 and mounting fasteners 16. The flange 24 defines an opening 24*a* (FIG. 3*b*) to permit engagement of cables from the vehicle with the terminals 32.

When the antenna assembly 10 is installed, the cover 20 will be fastened to the body 11 so that the antenna assembly is a one-piece component with the flange 24 projecting downward from the bottom face of the antenna assembly. This flange 24 can be easily pushed into a pre-drilled opening or bore in the roof of the vehicle to establish the orientation of the antenna assembly on the vehicle. Once the flange is properly positioned, the fasteners 16 can be passed through the openings 15*a* in the flange for engagement with the roof of the vehicle. In one embodiment, the fasteners 16 can be self-tapping sheet metal screws that can be easily threaded into the sheet metal roof of a vehicle. Alternatively, the screw openings in the flange 15 can be used as a drill guide to drill holes into the roof to receive conventional metal screws. The screws can then be threaded into the roof and tightened to secure the antenna assembly 10 to the vehicle body.

Figure 4:
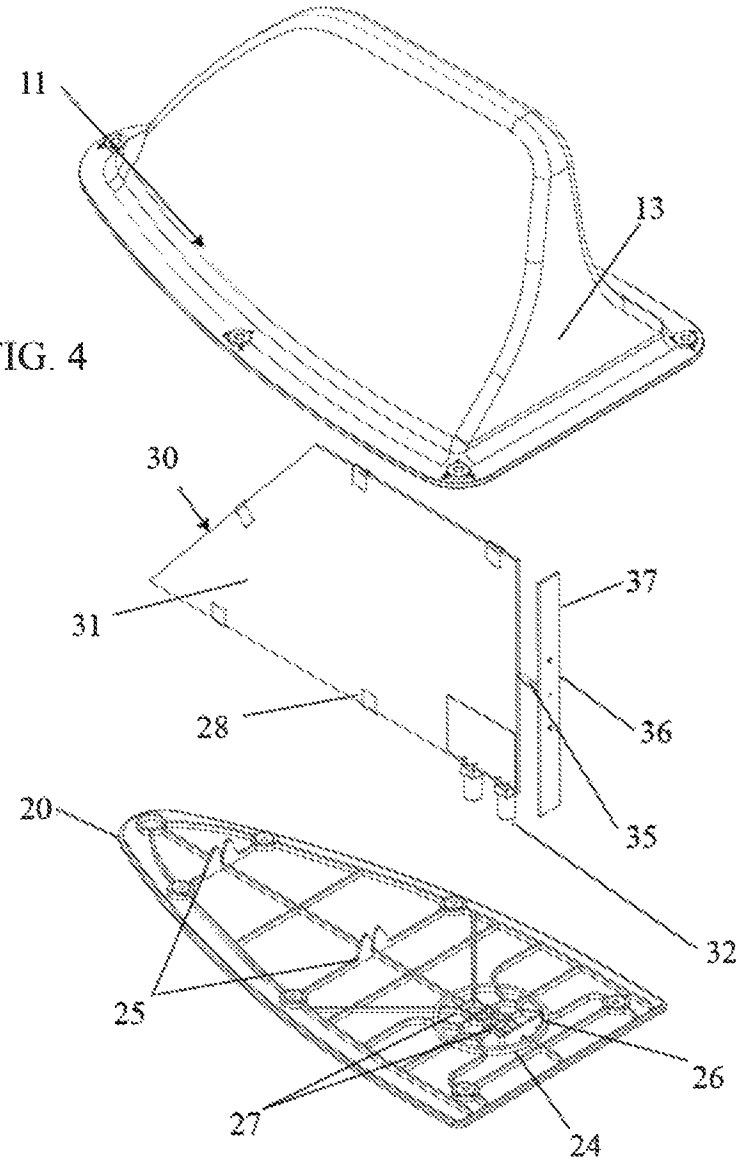
FIG. 4 is an exploded view of the antenna assembly shown in FIG. 1.

The cover 20 includes at least two clips or notches 25 projecting upward from an inner face of the cover, as shown in FIG. 4. The clips are configured to receive and support the substrate 31 of a circuit board assembly 30 that carries the receiving antenna and signal processing electronics for the antenna. The clips 25 engage the lower edge 30*a* of the planar antenna structure 30 to support the structure vertically or generally perpendicularly relative to the cover 20. Dampening strips 28 can provide an interface between the substrate 31 and the clips 25 to help reduce the effects of vibration as the antenna travels on a moving vehicle. The strips 28 can be formed of a foam or other resiliently compressible material adapted to reduce force transmission from the clips to the planar antenna structure. The cover 20 also includes a mounting frame 26 aligned with the projecting flange 24, in which the mounting frame is configured to support one end of the circuit board assembly 30. The frame 26 defines a pair of bores 27 to receive the electrical terminals 32 of the circuit board assembly, as seen in FIGS. 3*b* and 4. The body 11 of the antenna assembly 10 also includes clips 18 projecting from the inside surface along the top of the body 11, as shown in FIG. 2. These clips 18 engage the upper edge 30*b* of the planar antenna structure 30, and can include the foam strips 28 used at the lower clips 25 to reduce the effects of vibration. The clips 25 and 18 thus firmly support the circuit board assembly 30 vertically inside the body 11.

Figure 5:
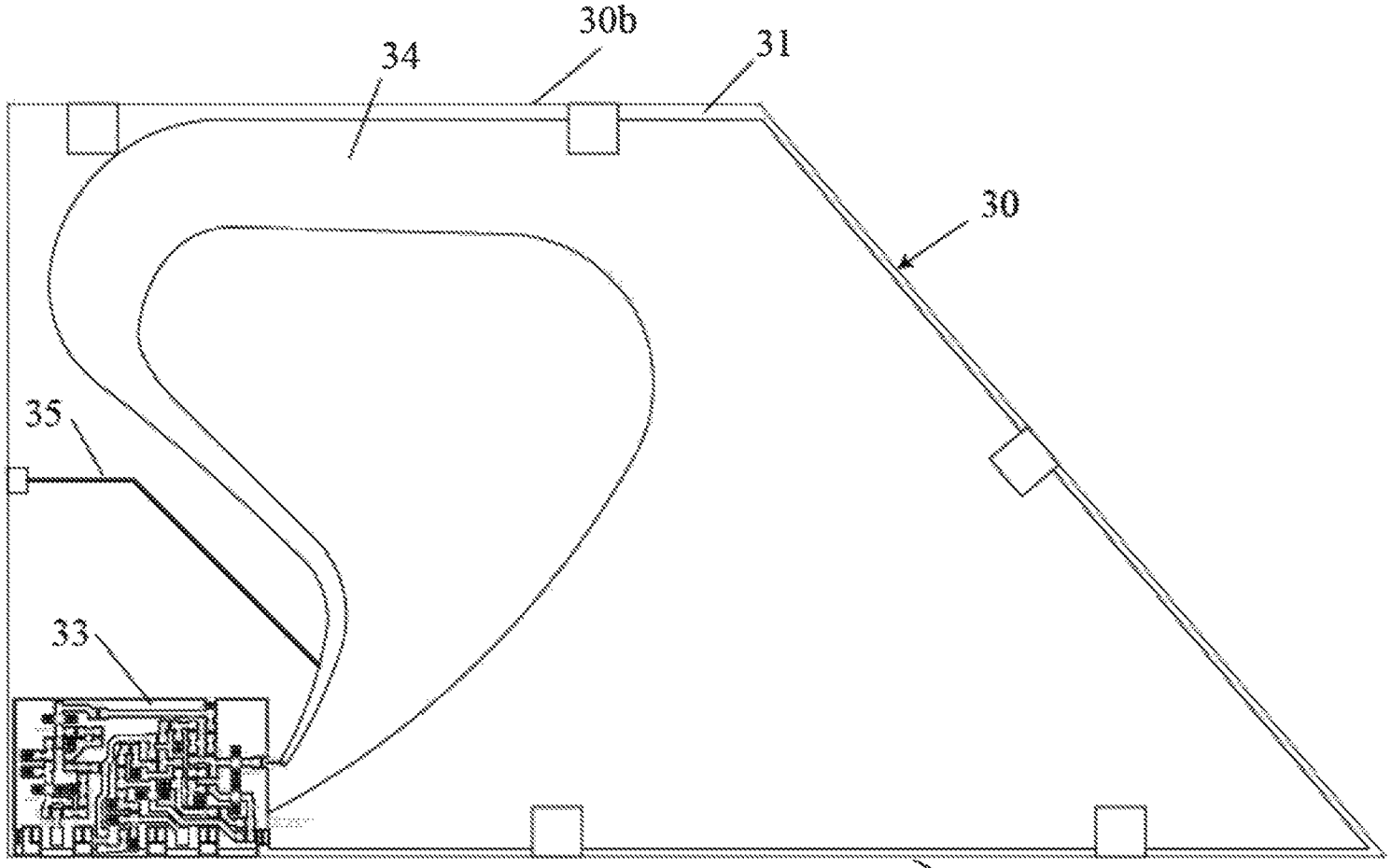
FIG. 5 is a side view of the circuit board assembly of the antenna assembly shown in FIG. 1.

The circuit board assembly 30 includes a printed circuit board (PCB) 33 at one corner of the substrate 31, as shown in FIG. 5, from which the terminals 32 extend. A planar antenna structure 34 is provided on the substrate and is electrically connected to the PCB in a conventional manner. The PCB 33 includes the circuitry and electronics needed to process the signal received by the antenna structure and to generate the signal conveyed at the terminals 32 and transmitted to the cables of the vehicle. The antenna structure is also electrically connected by a stranded wire 35 to a second printed circuit board 36 that is oriented perpendicular to the trailing edge of the substrate 31, as shown in FIG. 4. This second PCB 36 can be affixed to the back wall 13 of the body 11 such as with double-sided tape 37. The second PCB 36 can incorporate an AM/FM antenna.

The antenna assembly 10 is sized to house a planar antenna capable of receiving UHF/VHF signals as well as FM signals. Thus, one of the two terminals 32 transmits the UHF/VHF signal while the other of the terminals transmits the FM signal. The terminals can be conventional F-type fitting for connection to conventional TV cables. The antenna assembly 10 and particularly the body 11 is sized to minimize the prominence of the antenna assembly while still being capable of receiving the TV and radio signals. Moreover, the planar antenna structure 34, shown in FIG. 5, is configured to receive UHF/VHF signals, so the structure must have a certain surface area and configuration. As is known in the art of planar antennas, the ground plane of the antenna consumes the bulk of the surface area of the antenna structure, and the size of the ground plane determines certain performance aspects of the antenna, such as resonant frequency and gain. In the illustrated embodiment, the ground plane of the antenna structure 34 has an area of about 50 $in^2$ mounted on the substrate 31.

The body 11 of the antenna assembly is configured to generally conform to the shape of the antenna structure 30, as seen in FIG. 2. In one specific embodiment, the body 11 has a height of 7.0 in., and the flange 15 has a length of 14.5 in. and a width of 8 in. The flange 24 has a diameter of 2.4 in. and extends 0.5 in. below the bottom face of the cover 20, which is sufficient for engaging a wiring opening in the roof of the vehicle. In the specific embodiment, the cover 20 is fastened to the body 11 by five fasteners 22 threaded into five corresponding bosses 17. The flange 15 of the antenna assembly can be mounted to the vehicle by five fasteners 16.

The body 11 and cover 20 of the antenna assembly is preferably formed of a material suitable to withstand the elements impacting a traveling vehicle but will not interfere with the antenna reception function. Thus, in one embodiment the body and cover are formed of a plastic, and in a specific embodiment an ABS plastic. In the illustrated embodiment, the cover 20 is removably fastened to the body 11 by fasteners 22. This approach allows access to the PCBs 33, 36 and antenna structure 34, as may be desirable to effect repairs or replacement. Alternatively, the cover can be sealed to the body, such as by an adhesive or welding, in which case the entire antenna assembly 10 would be disposable in the event of a failure of one of the components.

The present disclosure should be considered as illustrative and not restrictive in character. It is understood that only certain embodiments have been presented and that all changes, modifications and further applications that come within the spirit of the disclosure are desired to be protected.

What is claimed is:

1. An antenna assembly for mounting on the roof of a vehicle, comprising:

a planar antenna structure configured to receive UHF/VHF signals;

a printed circuit board (PCB) electrically connected to said antenna structure for processing UHF/VHF signals received by the antenna structure, said PCB having at least one electrical terminal extending therefrom, each of said at least one electrical terminal configured for removable connection to a corresponding cable of the vehicle;

a body sized to surround the planar antenna structure with the planar antenna structure vertically oriented relative to the vehicle, said body including a mounting flange adapted to be fastened to the roof of the vehicle; and a cover attached to said body to completely enclose said planar antenna structure, said cover including a flange extending from a bottom surface of said cover for engagement within a complementary opening in the roof of the vehicle, said flange defining an opening to permit connection of the corresponding cable from the vehicle with a corresponding one of the at least one electrical terminals.

2. The antenna assembly of claim 1, wherein said cover includes at least one clip configured to engage a lower edge of the planar antenna structure to support the planar antenna structure perpendicularly relative to said cover.

3. The antenna assembly of claim 2, wherein said at least one clip includes two clips.

4. The antenna assembly of claim 2, wherein said antenna body includes at least one clip configured to engage an upper edge of the planar antenna structure opposite the lower edge.

5. The antenna assembly of claim 2, further comprising dampening strips disposed between said at least one clip and said lower edge of the planar antenna structure, said dampening strips configured to reduce force transmission from said at least one clip to said planar antenna structure.

6. The antenna assembly of claim 1, wherein said cover is removably attached to said body.

7. The antenna assembly of claim 1, wherein said body defines a shark fin configuration.

8. The antenna assembly of claim 7, wherein said body includes a leading edge that is at a non-perpendicular angle relative to said mounting flange.

9. The antenna assembly of claim 8, wherein said leading edge is at an angle of 40-60° relative to the mounting flange.

10. The antenna assembly of claim 1, wherein said body includes opposite side walls converging to a leading edge and including a rear wall opposite said leading edge.

11. The antenna assembly of claim 10, wherein said rear wall is wider adjacent the mounting flange than at an upper end of said rear wall opposite said mounting flange.

12. The antenna assembly of claim 11, wherein said opposite side walls are curved between said mounting flange and said upper end of said rear wall.

13. The antenna assembly of claim 1, further comprising an AM/FM antenna for receiving AM/FM signals electrically connected to said PCB.

14. The antenna assembly of claim 13, wherein said AM/FM antenna is incorporated in a printed circuit board that is mounted to said body.

15. The antenna assembly of claim 1, wherein said body and said cover are formed of a plastic.

16. The antenna assembly of claim 15, wherein said plastic is an ABS plastic.

* * * * *